US006296239B1

(12) United States Patent
Sawyer

(10) Patent No.: US 6,296,239 B1
(45) Date of Patent: Oct. 2, 2001

(54) AUTOMOBILE BODY PARTS HOLDER ASSEMBLY

(75) Inventor: John Lister Sawyer, Brentford (GB)

(73) Assignee: Garage Mate Limited (GB)

( * ) Notice: Subject to any disclaimer, the term of this patent is extended or adjusted under 35 U.S.C. 154(b) by 0 days.

(21) Appl. No.: 09/508,792

(22) PCT Filed: Sep. 24, 1998

(86) PCT No.: PCT/GB98/02879

§ 371 Date: Mar. 15, 2000

§ 102(e) Date: Mar. 15, 2000

(87) PCT Pub. No.: WO99/16589

PCT Pub. Date: Apr. 8, 1999

(30) Foreign Application Priority Data

Sep. 26, 1997 (GB) ..... 9720398

(51) Int. Cl.[7] ..... B66F 5/04

(52) U.S. Cl. ..... 269/17; 269/71; 269/67; 269/68

(58) Field of Search ..... 269/17, 71, 67, 269/68, 60; 254/133, 134, 2 B, DIG. 16

(56) References Cited

U.S. PATENT DOCUMENTS 5,203,540 * 4/1993 Lee ..... 254/8 B
5,549,287 * 8/1996 Loucks ..... 269/17

* cited by examiner

*Primary Examiner*—Robert C. Watson
(74) *Attorney, Agent, or Firm*—Wells, St. Johns, Roberts, Gregory & Matkin

(57) ABSTRACT

A jig is disclosed and which includes a carrier; an elongate member having an end portion which is located relative to the carrier so that the elongate member is movable arcuately upward and downwardly on a first axis and is rotatable on a second axis extending at right angles to the first axis; an article engaging assembly located at an end portion of the elongated member remote from the first and second axis is provided, and is movable towards and away from the elongate member on a third axis extending transversely of the elongate member.

8 Claims, 9 Drawing Sheets

AUTOMOBILE BODY PARTS HOLDER ASSEMBLY

RELATED PATENT DATA

Figure 1:
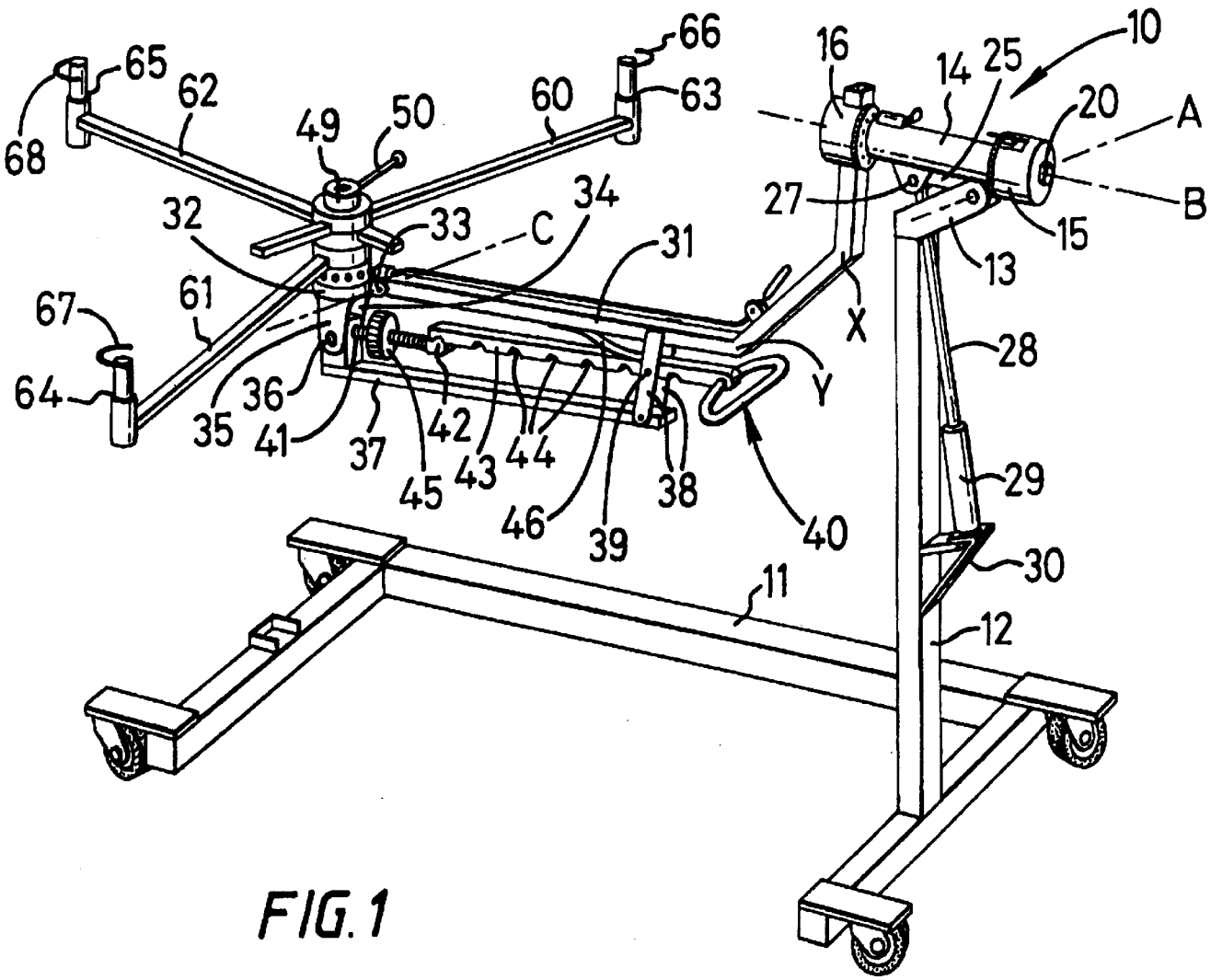

This application claims priority from PCT/GB98/02879, which was filed on Sep. 24, 1998, and which further claims priority from Great Britain, patent Application Ser. No. 9720398.8, which was filed on Sep. 26, 1997.

This invention relates to a jig

In GB-A-2 223 460 there is disclosed a jig comprising a carrier and an elongate member an end portion of which is located relative to the carrier so that the elongate member is moveable arcuately upwardly and downwardly on a first axis and is rotatable on a second axis extending at right angles to the first axis.

In U.S. Pat. No. 5,549,287 there is disclosed a jig comprising a carrier and an elongate member an end portion of which is located relative to the carrier so that the elongate member is moveable upwardly and downwardly and is rotatable on an axis extending at right angles to the upward and downward movement.

The jigs disclosed in the two documents are intended for supporting motor vehicle panels and other bodywork members to be worked on and provide adjustment whereby the panels and other bodywork members may be supported in a variety of positions while worked on.

While the jigs disclosed in the two documents may be suitable for supporting motor vehicle panels and other bodywork members in a variety of positions, they do not include means for facilitating movement of such panels and other bodywork members towards and away from the elongate member. Therefore, such jigs do not provide a device capable of manoeuvering such panels and other bodywork members through any degree of are in any radius.

In U.S. Pat. No. 5,203,540 there is disclosed a jig comprising a carrier and an elongate member an end portion of which is located relative to the carrier so that the elongate member is moveable arcuately upwardly and downwardly on a first axis. However, the elongate member is not rotatable on a second axis extending at right angles to the first axis. The elongate member is a parallel crank four-bar linkage arranged to prevent angular deviation of a connecting bar supporting a mounting means, the connecting bar being a component of the elongate member.

According to the invention, there is provided a jig comprising a carrier and an elongate member an end portion of which is located relative to the carrier so that the elongate member is moveable arcuately upwardly and downwardly on a first axis and is rotatable on a second axis extending at right angles to the first axis characterised in that there is provided article engaging means located at an end portion of the elongate member remote from the first and second axes and moveable towards and away from the elongate member on a third axis extending transversely of the elongate member.

Following is a description, by way of example only and with reference to the accompanying drawings, of one method of carrying the invention into effect.

Figure 2:
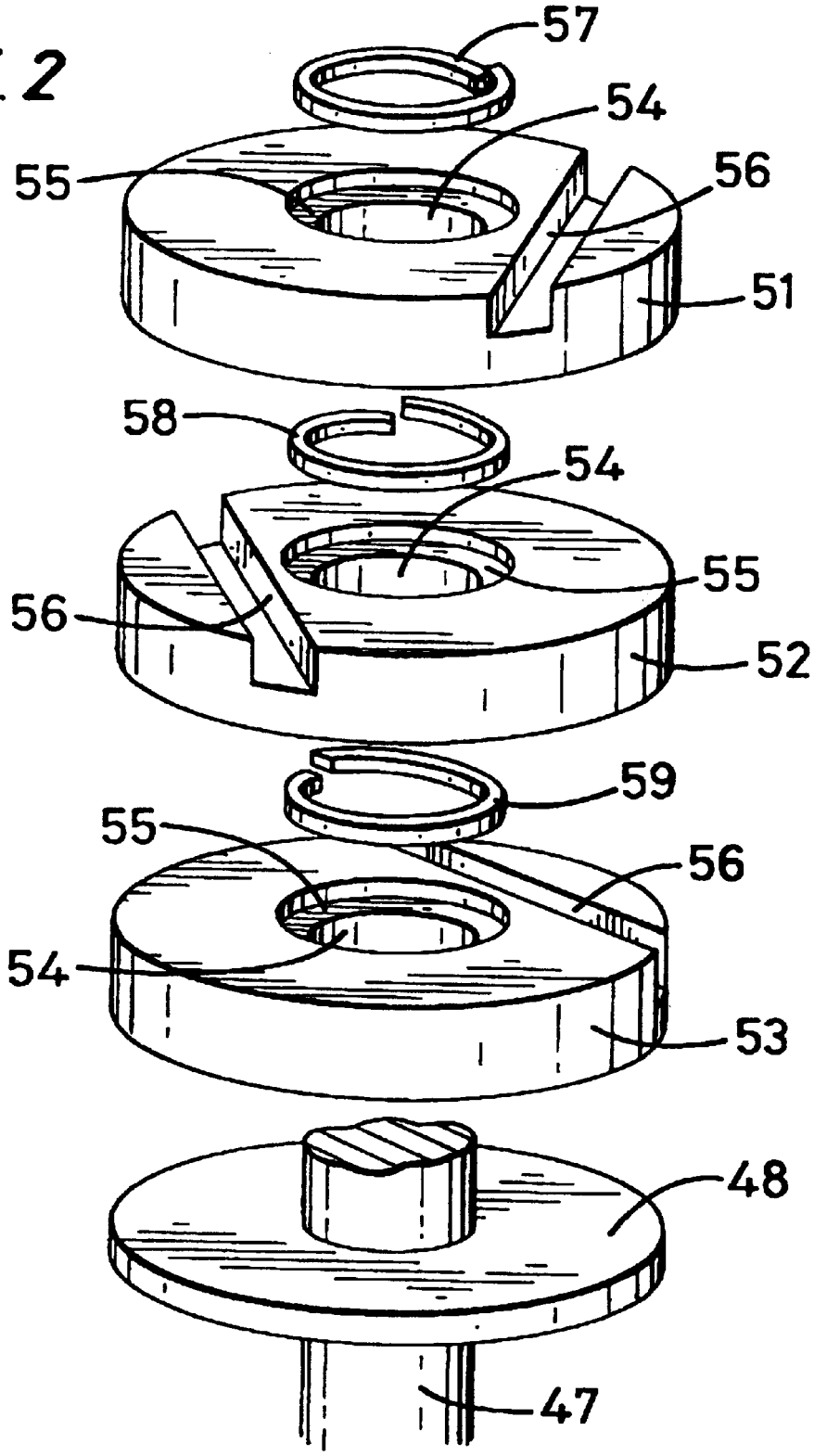
Figure 3:
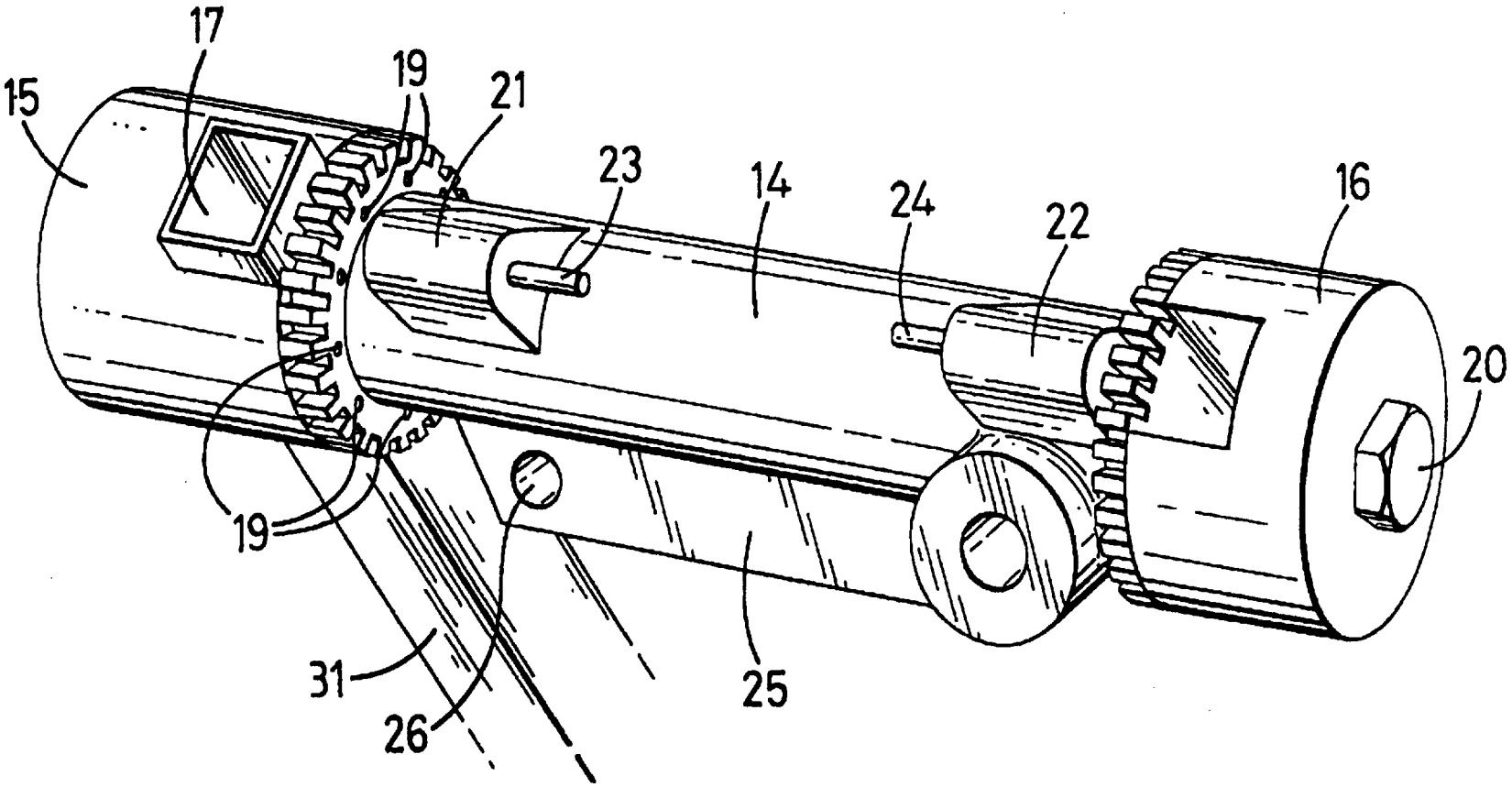
Figure 9:
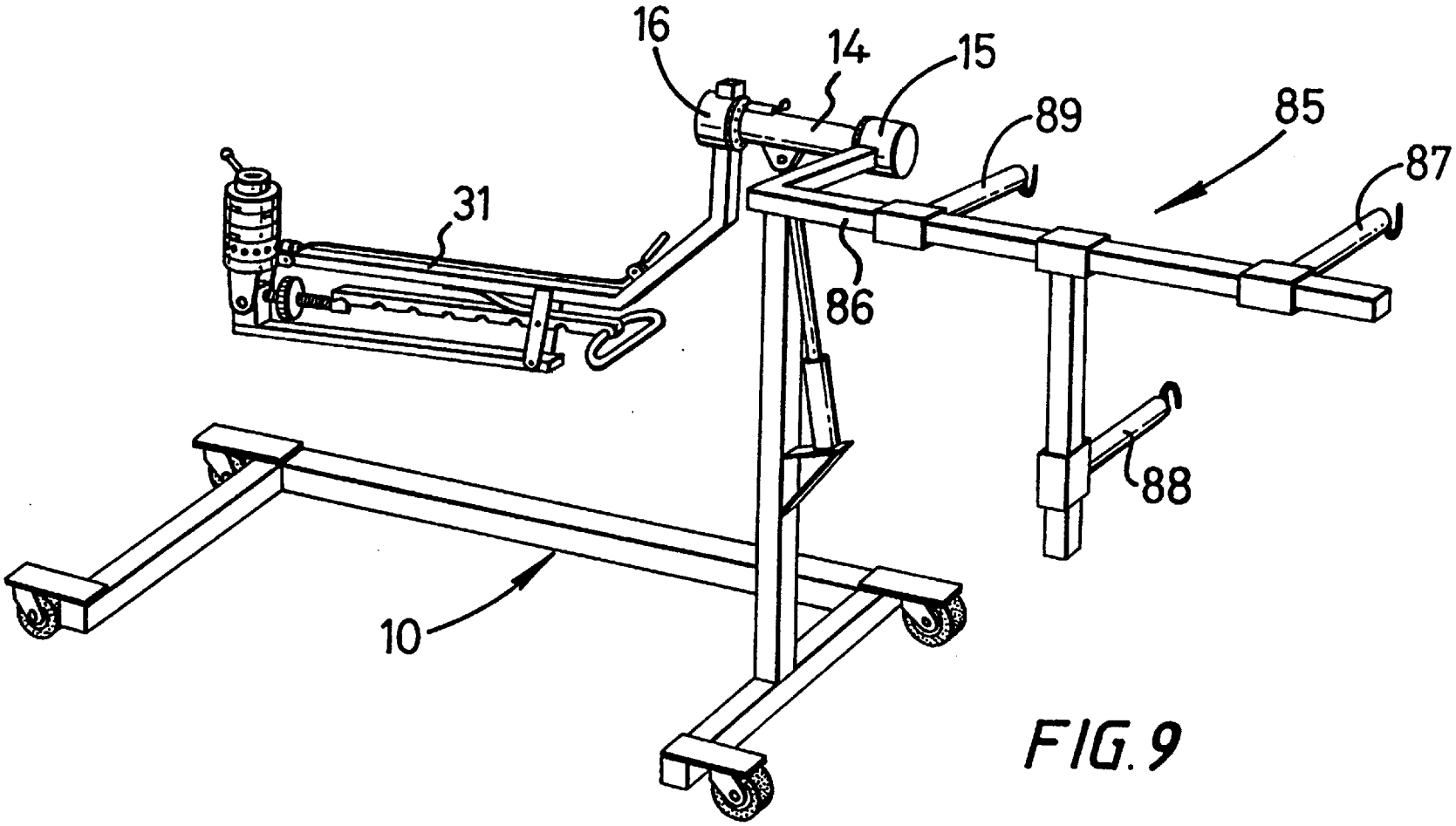

In the drawings:

FIG. 1 is a diagrammatic representation of one embodiment of a jig in accordance with the present invention, FIG. 2 is an exploded view of a hub assembly of the embodiment of the jig shown in FIG. 1, FIG. 3 is a detailed view of a bearing assembly of the embodiment of the jig shown in FIG. 1, FIGS. 4*a*, 4*b*, 5, 6 and 7 are diagrammatic representations showing examples of the embodiment of the jig shown in FIG. 1 when in use, FIGS. 8*a*,8*b*,8*c* and 8*d* are diagrammatic representations, shown partly in cross section, of a modified gripper carrier for the embodiment of the jig shown in FIG. 1, and FIG. 9 is a diagrammatic representation showing additional frame work adapted to be connected to the embodiment of the jig shown in FIG. 1.

Referring now to FIGS. 1 to 3 of the drawings, there is shown a jig 10 in the form of an elongate wheeled carriage 11, comprising an elongate portion and transverse portions extending in the same direction from opposite ends of the elongate portion, and a post 12 upstanding from one of the transverse portions. An upper end portion of the post 12 is formed as a bracket 13 and an outer end portion of the bracket 13 is formed as a shaft (not shown) on which an end portion of an elongate cylindrical bearing assembly 14 is rotatably mounted, a central longitudinal axis A of the shaft extending transversely of a central longitudinal axis B of the bearing assembly 14. The bearing assembly 14 is provided at opposite end portions thereof with cylindrical end caps 15,16 which are rotatably mounted on the central longitudinal axis B of the bearing assembly 14. The end caps 15,16 are each provided with radial bores 17,18 of rectangular transverse configuration and the end caps 15,16 are of larger diameter than the bearing assembly 14. Annular surfaces of the end caps 15,16 which face one another are provided with recesses 19 located at spaced intervals circumferentially of the annular surfaces. Outer end walls of the end caps 15,16 are provided with threaded bores (not shown) opening into the radial bores 17,18 to receive screw threaded shanks of corresponding bolts 20. The bearing assembly 14 is provided with radially extending projections 21,22 at opposite end portions thereof, the projections 21,22 each having located therein a pin 23,24 extending parallel to'the longitudinal axis B of the bearing assembly 14 and being longitudinally slideable relative to the projections 21,22 so that corresponding end portions of the pins 23,24 are receivable in corresponding recess 19 so as to restrain uncontrolled rotation of the end caps 15,16 relative to the bearing assembly 14.

The bearing assembly 14 also comprises a longitudinal flange 25 extending radially outwardly thereof, the flange having an aperture 26 therein at a location remote from the bracket 13. The aperture 26 has received therein a pin 27 linking the flange 25 with an upper end portion of an hydraulic ram 28 the cylinder 29 of which is pivotally connected to a bracket 30 secured to a lower portion of the post 12. The arrangement is such that operation of the ram 28 causes the bearing assembly 14 to move arcuately relative to the axis A.

The radial bore 18 of the end cap 16 has received therein an end portion of an elongate member 31 of rectangular cross section which is double cranked, that is, it is formed with an elbow configuration as shown at X and Y, such that a longitudinal axis of a greater proportion of the elongate member 31 is substantially parallel to the longitudinal axis B of the bearing assembly 14. A surface of the said end portion of the elongate member 31 is provided with a threaded recess (not shown) and the elongate member 31 is secured relative to the end cap 16 by means of a bolt, corresponding to the bolt 20, the shank of which is secured in the corresponding screw threaded bore of the end cap 16 and the threaded recess of the elongate member 31.

An end portion of the elongate member 31 remote from the end cap 16 is rounded and is provided with a transverse bore, the rounded end portion being received between two spaced flanges, each also provided with a bore, of a bearing housing 32, the flanges and the end portion of the elongate member 31 being connected one to another by means of a pin extending through the bores of the flanges and the transverse bore of the elongate member 31 thereby providing a pivot assembly 33 connecting the elongate member 31 and the bearing housing 32 and providing a pivot axis C.

The bearing housing 32 also comprises a pair of depending lugs 34,35 which are tapped to receive a pin 36 extending between the lugs 34,35. The pin 36 has pivotally located thereon one end portion of an elongate trailing link 37 a remote end portion of which is slideable in guides located at lower portions of a pair of spaced projections 38 secured to and depending from the elongate member 31. The projections 38 are connected one with another by means of a transverse pin 39.

An adjustment mechanism 40 is provided for effecting pivotal movement of the bearing housing 32 relative to the elongate member 31 at the pivot assembly 33. The mechanism 40 comprises a cylindrical bearing (not shown) coaxial with the pin 36 and having a radially extending union for rotatably locating an end portion of a shaft 41 an opposite end portion of the shaft 41 being threaded and being located in a threaded bore in a lug 42 which is secured to an end portion of an elongate rack 43 having longitudinally spaced notches 44. The shaft 41 has secured thereto midway along the length thereof a disc 45. An end portion of an elongate leaf spring 46 is secured to a lower surface of the elongate member 31 adjacent the rack 43 and a remote end portion of the leaf spring 46 bears against the rack 43 such that the rack 43 engages the pin 39 extending between the projections 38 and the pin 39 locates in a selected notch 44 of the rack 43.

The arrangement is such that the bearing housing 32 is pivotable relative to the elongate member 31 by adjusting the length of the combined shaft 41 and rack 43 between the pins 36 and 39, the arrangement being stabilised by engaging a selected notch 44 of the rack 43 with the pin 39. Such selection of the notches 44 ensures a coarse adjustment of the mechanism 40 and rotation of the disc 45 effects a finer adjustment of the mechanism 40.

The bearing housing 32 is a cylindrical member in a central bore of which is located a lower portion of a shaft 47 on which is secured a disc 48, which seats on the bearing housing 32, the disc 48 being located intermediate end portions of the shaft 47. An upper end portion of the shaft 47 is screw threaded and receives a nut 49 having a fulcrum arm 50. An upper portion of the shaft 47 located between the disc 48 and the nut 49 has located thereon three discs 51,52,53 each of which is provided with a central bore 54 and an upper surface of which is recessed circumferentially of the bore 54 as shown at 55. The upper surface of each of the discs 51,52,53 is also provided with an elongate recess 56 which is of rectangular transverse cross section. The recessed portions 55 of each of the discs 51,52,53 each receive a corresponding one of three spring washers 57,58, 59.

Each of the recesses 56 has located therein a corresponding one of three elongate arms 60,61,62 of rectangular transverse cross section and an outer end portion of each of which is formed as a spigot for location in a transversely extending recess of a corresponding one of three elongate gripper carriers 63,64,65 a lower end portion of each of which is provided with a threaded bore extending into the transverse recess and in which are threaded corresponding grub screws so as to secure each of the carriers 63,64,65 in an upright position relative to outer end portions of the arms 60,61,62. Each of the carriers 63,64,65 is formed at an upper end portion thereof as a screw threaded spigot for receiving a corresponding one of three gripper devices 66,67,68.

It will be appreciated that movement of the arms 60,61,62, so as to adjust the distance of each corresponding gripper carrier 63,64,65 from the bearing housing 32, may be effected by unscrewing the nut 49 so that longitudinal movement of the arms 60,61,62 relative to the bearing housing 32 may be carried out and by subsequently tightening the nut 49 after adjustment has been effected.

The gripper devices 66,67,68 are adapted to engage a work piece and may be of any suitable configuration, for example they may be of ring or channel configuration or they may provide hooks for engaging corresponding components on the work piece.

It will also be appreciated that the jig 10 may be operated to locate a work piece in any position since operation of the ram 28 will cause the elongate member 31 to pivot in an arcuate direction relative to the axis A; rotation of the end cap 16 will effect turning of the elongate member 31 relative to the axis B; operation of the adjustment mechanism 40 will effect orientation of a plane containing the work piece where the plane intersects the work piece and the gripper devices 66,67,68; and the whole of the article engaging means, comprising the arms 60 to 62, the gripper carriers 63 to 65 and the gripper devices 66 to 68, is rotatable on the central longitudinal axis of the bearing housing 32.

Figure 4A:
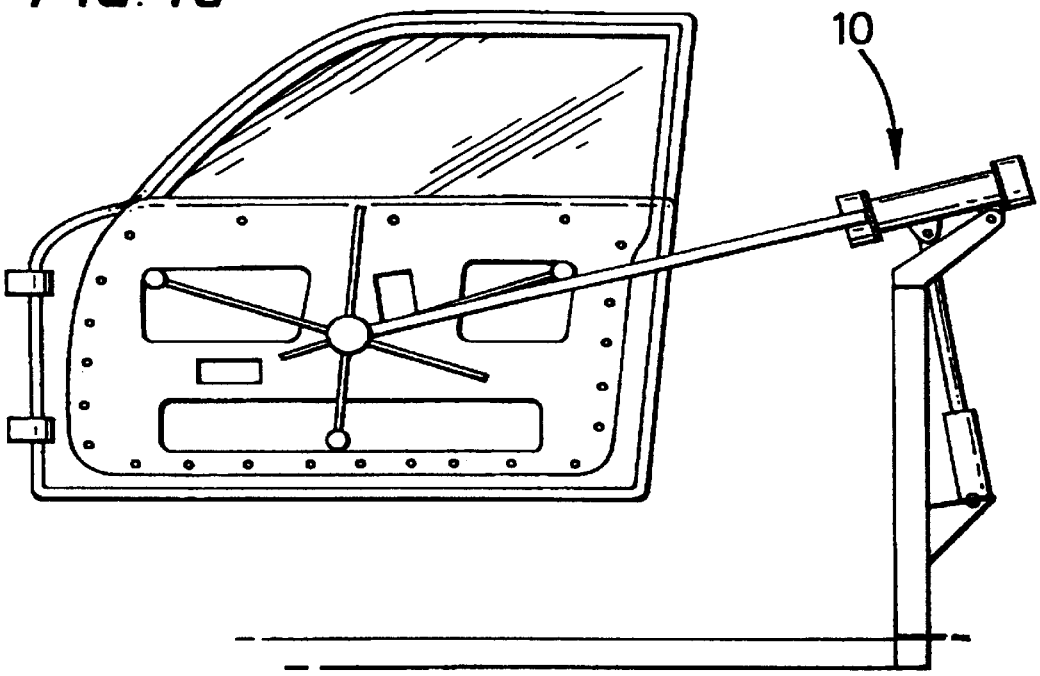
Figure 4B:
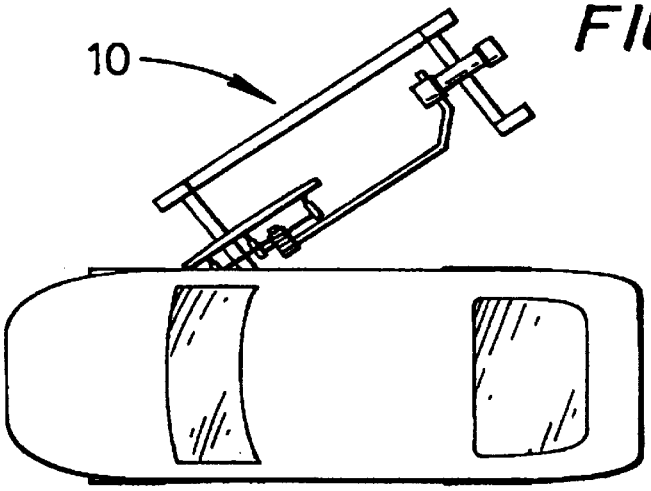

Examples of how the jig 10 may be used are shown in each of FIGS. 4*a*,4*b*,5,6 and 7. An advantage of the jig 10 is that the weight of a heavy object, such as a vehicle door, can be supported in a stable condition by the jig 10, as shown in FIG. 4*a*, due to the pressure of hydraulic fluid operating on the ram 28. The jig 10 can thus be wheeled to a motor vehicle, as shown in FIG. 4*b*, and manoeuvered such that the gripper devices 66,67,68 can engage a damaged body part, such as a door, of the vehicle and can support the part while it is disengaged from the vehicle. The jig 10 can then be wheeled from the vehicle, as shown in FIG. 4*a,* to a location where the part can be worked upon. At the location the orientation of the part, while still mounted on the jig 10, may be adjusted, for example by rotating the elongate member 31 relative to axis B so that the vehicle part is horizontal instead of vertical, as shown in FIG. 4*a*. The stability provided by the hydraulic ram 28 and the catelevered arrangement of the elongate member 31 and the post 12 being located at one end of the carriage 11, ensures that the vehicle part carried by the jig 10 can be worked upon as safely and as securely as if on a work bench. After repair, the jig 10 would be wheeled back to the motor vehicle and manoeuvered such that the part could be realigned in position and supported in that position by the jig 10 until the part is firmly secured in place on the motor vehicle body. At no stage would it be necessary to remove the vehicle part from the jig 10.

This whole procedure could be carried out by one person, an operation which, in the absence of the present invention, would otherwise be carried out by two or more persons who would be required to support the vehicle part while it is disengaged from a vehicle, to transport the part to a work bench or jig known hitherto for working upon and, subsequently, to transport the vehicle part, after repair, back to the vehicle and to support the vehicle part while it is re-assembled with the vehicle.

Figure 5:
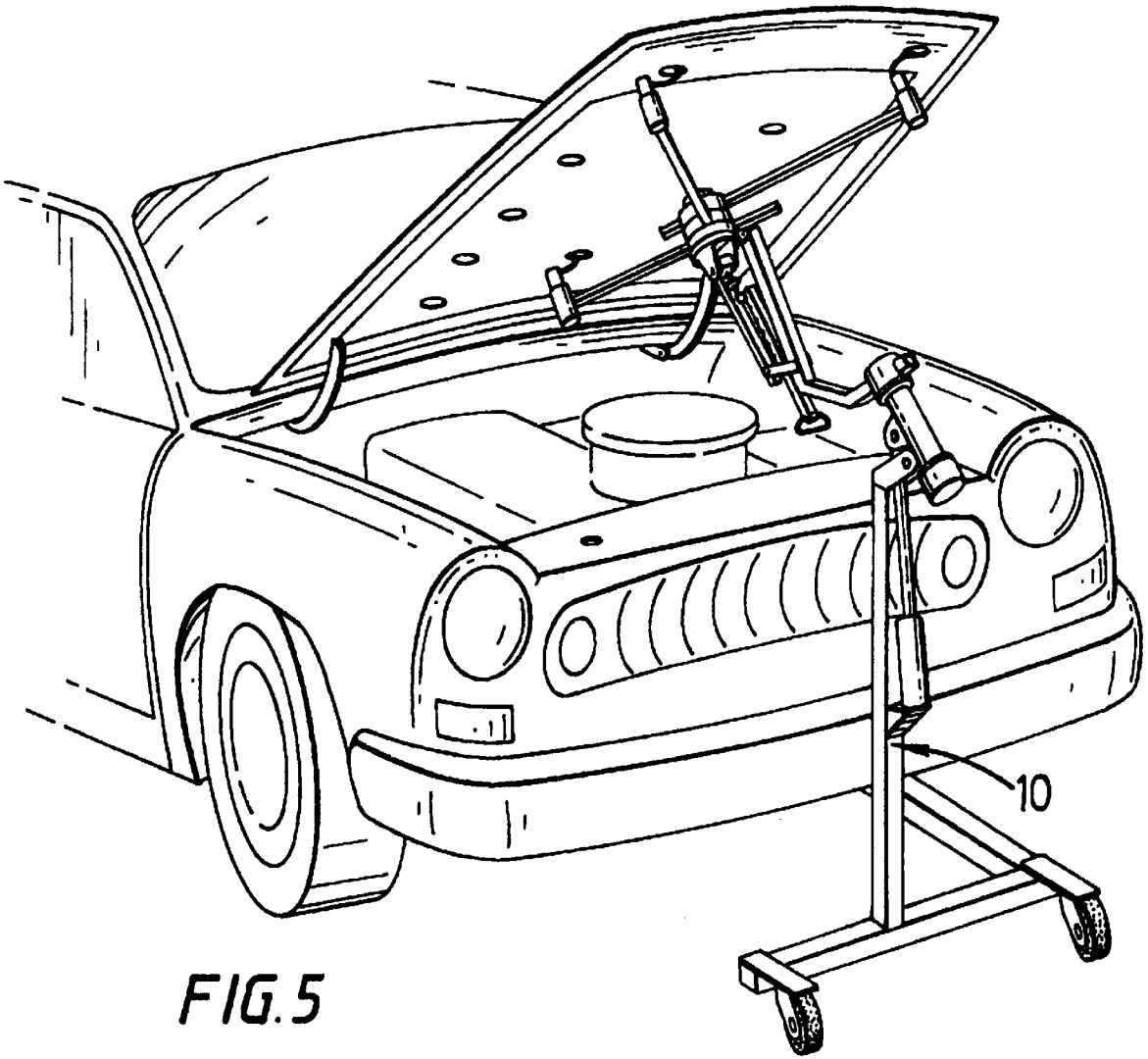

Another advantage of the jig 10 is that, due to the catelevered arrangement of the elongate member 31, the jig 10 may be located so as to engage an object which may otherwise be difficult to access, as illustrated in FIG. 5.

Figure 6:
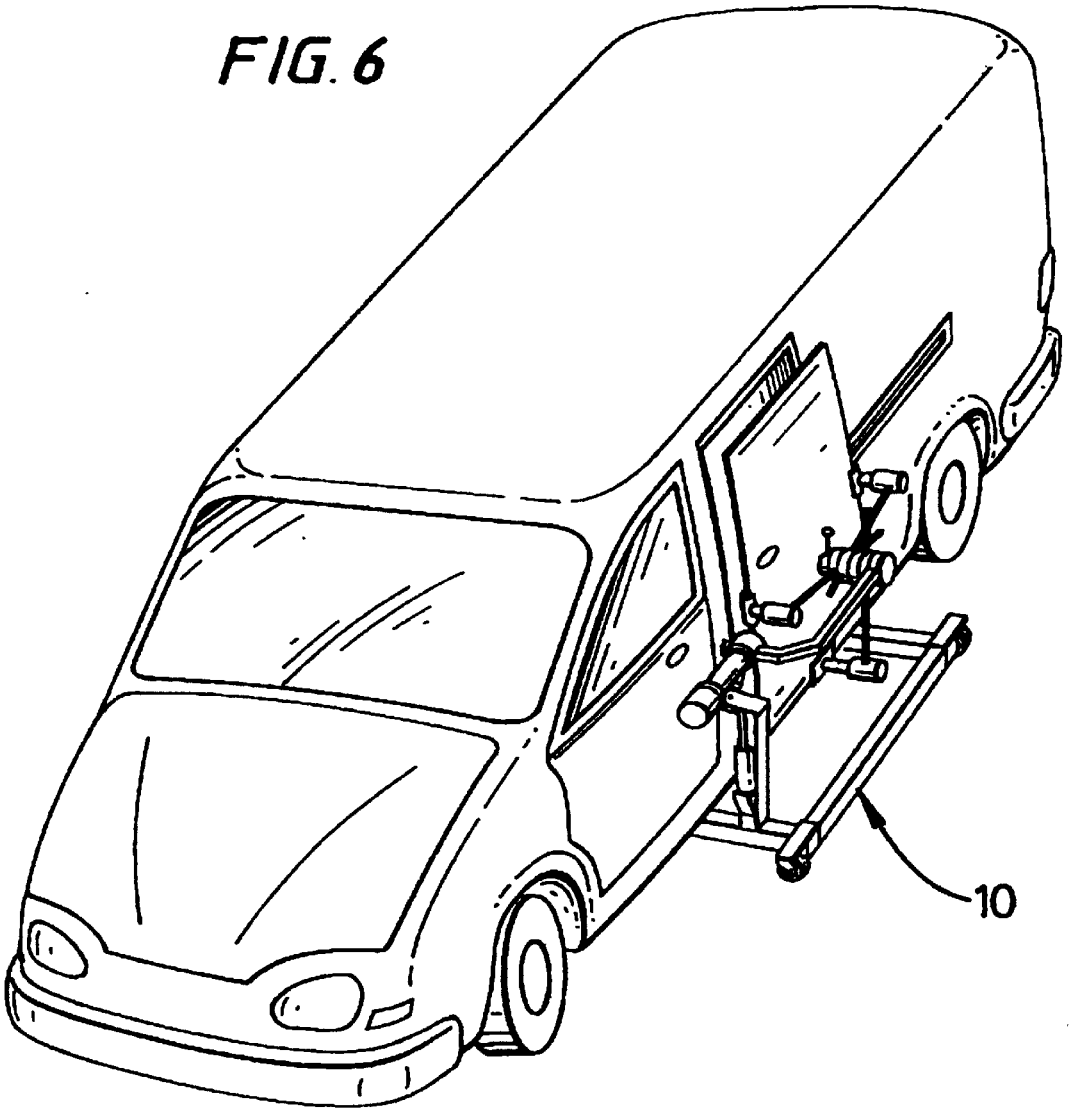

A further advantage of the jig 10 is that the gripper devices 66,67,68 can be positioned in practically any position so as to support an object, while ensuring that the object is in a balanced condition. In FIG. 6, for example, the jig 10 is shown in a position in which it supports a heavy door of a motor vehicle, the door being supported above an area bounded by the carriage 11.

The configuration of the carriage 11 is also advantageous in that it comprises an elongate portion and transverse portions extending in the same direction from opposite ends of the elongate portion. The configuration facilitates manoeuvering the jig 10 around a roadwheel of a motor vehicle, for example, when it is required to position the elongate member 31 over a portion of the vehicle above the wheel.

A further advantage of the jig 10 is that it can be adjusted, to the position shown in FIG. 6 for example, to occupy minimum space for storage purposes.

It will be appreciated that the purpose of providing the elongate member with a double cranked or elbow configuration, as shown at X and Y, is to provide for improved clearance compared with single 90° angle formation.

Figure 7:
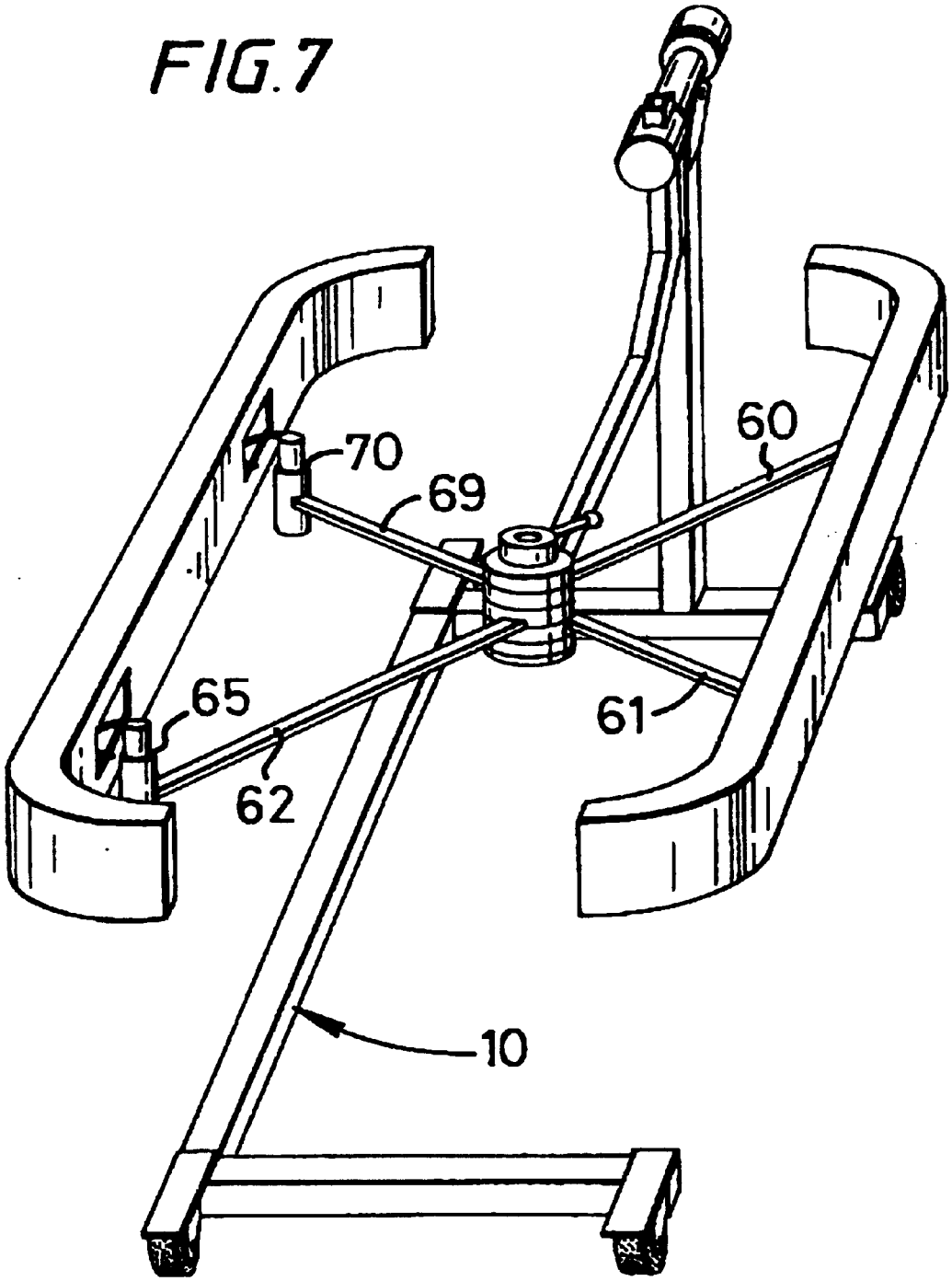
Figure 8A:
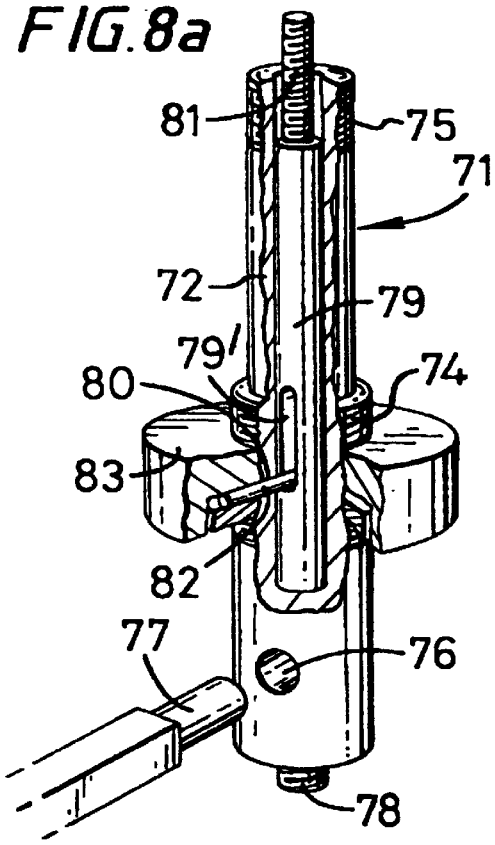
Figure 8B:
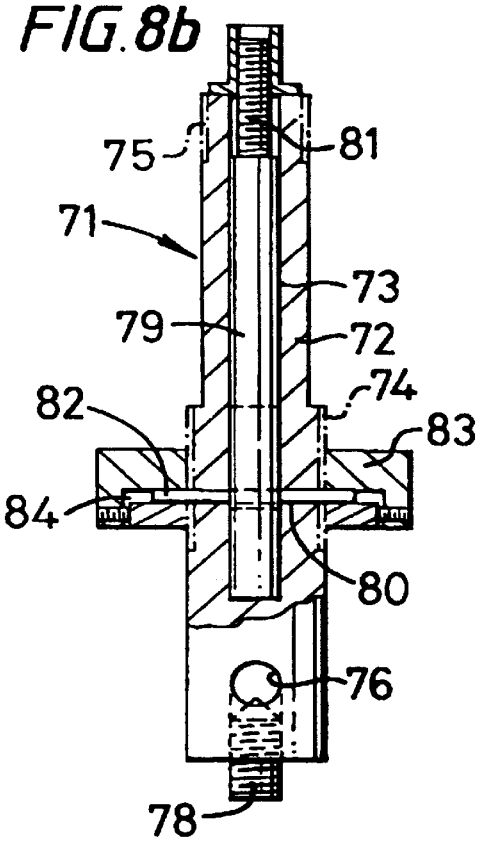
Figure 8D:
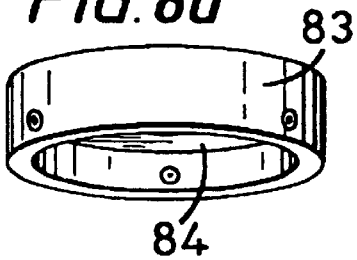
Figure 8C:
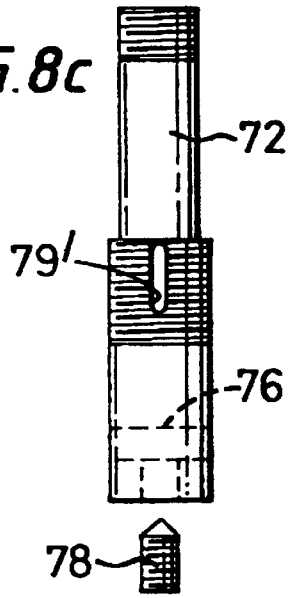

It will be appreciated that the jig 10 may be provided with one or more additional arms 69 and corresponding gripper carriers 70, see FIG. 7, by providing the shaft 47 with a greater longitudinal dimension and by providing corresponding extra discs additional to the discs 51,52,53.

Referring now to FIGS. 8*a*,8*b*,8*c* and 8*d* of the drawings, there is shown an adjustable gripper carrier 71 for replacing each of the gripper carriers 63,64,65. The carrier 71 comprises a cylindrical component 72 having an internal bore 73, an external screw thread 74 located intermediate upper and lower end portions of the carrier 71 and an upper screw thread 75. A lower portion of the carrier 71 is provided with a radial bore 76 for receiving a spigot 77 at an end portion of an arm 60 or 61 or 62, the arm being secured relative to the carrier 71 by means of a grub screw 78 which is screwed into the internal bore 73, a lower end portion of which is threaded for that purpose. The cylindrical component 72, in the region of the external screw thread 74, is provided with a longitudinally extending slot 79. The bore 73 of the cylindrical component 72 has located therein a rod 79 a lower end portion of which is provided with a transverse bore 80 and an upper end portion of which is provided with an external screw thread 81. The transverse bore 80 of the rod 79 has located therein a pin 82. The external screw thread 74 cooperates with an internal screw thread of a travelling thumb screw 83 an internal wall of which is provided with a circumferential recess 84 for receiving opposite end portions of the pin 82. The arrangement is such that, rotation of the thumb screw 83 relative to the cylindrical portion 72 results in movement of the thumb screw 83 longitudinally of the cylindrical portion 72, the pin 82 moving longitudinally of the slot 79, thereby effecting longitudinal movement of the rod 79 in the bore 73 of the cylindrical member 72.

Referring now to FIG. 9 of the drawings there is shown an extension apparatus 85 comprising a second elongate member 86 of rectangular transverse cross section an end portion of which is secured in the end cap 15, in the same way as the elongate member 31 is secured in the end cap 16, and on which is located at spaced intervals brackets 87,88,89 for mounting thereon, for example, a motor vehicle body panel which is to be paint sprayed.

It will be appreciated that a jig in accordance with the present invention provides a device capable of manoeuvering items weighing from grammes to tons through any degree of arc in any radius. The hydraulic ram 28 provides a crane arrangement for effecting vertical adjustment; the rotatable end cap 16 provides adjustment from a horizontal orientation to azimuth and beyond; the shaft 47 and discs 51 to 53 provide a rotatable hub assembly for three or more gripper arms 60 to 63 which can be adjusted independently of one another through 360° of arc and longitudinally so that gripper carriers 63 to 65 are adjustable for any required distance from the axis of rotation of the shaft 47; the pivot assembly 33 provides for tilting of the hub assembly 32 towards and away from the elongate member 31; and the wheeled carriage 11 ensures that the whole apparatus is transportable.

What is claimed is:

1. A jig comprising: a carrier; an elongate member having a first end portion which is located relative to the carrier so that the elongate member is movable arcuately upwardly and downwardly on a first axis (A) and is rotatable on a second axis (B) extending at right angles to the first axis (A); article engaging means located at a second end portion of the elongate member remote from the first and second axes (A,B) and movable towards and away from the elongate member on a third axis (C) extending transversely of the elongate member wherein the elongate member includes an elbow configuration adjacent the said first end portion thereof such that, when the elongate member turns on the said second axis (B), the said second end portion of the elongate member moves in an arcuate path and the article engaging means is located inwardly of the arcuate path.

2. A jig as claimed in claim 1 wherein there is provided means for adjusting location of the article engaging means relative to each of the three axes (A,B,C).

3. A jig as claimed in claim 2 wherein the means for adjusting location of the article engaging means relative to the second axis (B) comprises a housing, an axis of which is coaxial with the second axis (B), and a rotatable member carried on the housing and rotatable on the second axis, the rotatable member being adapted to engage with the said first end portion of the elongate member.

4. A jig as claimed in claim 3 wherein there is provided means for restraining rotation of the rotatable member on the said second axis (B).

5. A jig as claimed in claim 2 wherein the means for adjusting location of the article engaging means relative to the third axis (C) comprises a mechanism for effecting coarse and fine adjustment.

6. A jig comprising: a carrier; an elongated member a first end portion of which is located relative to the carrier so that the elongate member is movable arcuately upwardly and downwardly on a first axis (A) and is rotatable on a second axis (B) extending at right angles to the first axis (A); article engaging means located at a second end portion of the elongate member remote from the first and second axes (A,B) and movable towards and away from the elongate member on a third axis (C) extending transversely of the elongate member wherein the elongate member includes an elbow so that a portion thereof carrying the article engaging means extends at right angles to a portion thereof located at the carrier.

7. A jig comprising: a carrier; an elongate member a first end portion of which is located relative to the carrier so that the elongate member is movable arcuately upwardly and downwardly on a first axis (A) and is rotatable on a second axis (B) extending at right angles to the first axis (A); article engaging means located at a second end portion of the elongate member remote from the first and second axes (A,B) and movable towards and away from the elongate member on a third axis (C) extending transversely of the elongate member wherein the carrier is an elongate wheeled carriage with an elongate portion and transverse portions extending in the same direction from opposite ends of the elongate portion and includes an upstanding member located at one of the transverse portions thereof for locating the said first end portion of the elongate member.

8. A jig as claimed in claim 7 wherein the carriage comprises an elongate portion and transverse portions extending in the same direction from opposite ends of the elongate portion.

* * * * *